US006397535B1

(12) United States Patent
Kim et al.

(10) Patent No.: US 6,397,535 B1
(45) Date of Patent: Jun. 4, 2002

(54) HEIGHT-ADJUSTABLE CONCRETE MOLD SUPPORTING SYSTEM AND METHOD FOR CONSTRUCTING CONCRETE BUILDING

(76) Inventors: Gwang Sik Kim, 1310-302, Jukong Apt, Haan-dong, Kwangmyeong-si, Kyonggi-do; Jae Gwan Kim, 323-33, Eunhaeng-dong, Siheung-si, Kyonggi-do, both of (KR)

( * ) Notice: Subject to any disclaimer, the term of this patent is extended or adjusted under 35 U.S.C. 154(b) by 0 days.

(21) Appl. No.: 09/617,093

(22) Filed: Jul. 14, 2000

(51) Int. Cl.[7] ..... E04B 1/00

(52) U.S. Cl. ..... 52/250; 52/293.3; 52/274; 52/713; 52/715; 249/18; 249/24; 249/25; 249/29; 249/30; 248/55; 248/295; 248/296; 248/298

(58) Field of Search ..... 52/250, 293.3, 52/274, 713, 715; 249/18, 24, 25, 29, 30; 248/55, 295, 296, 298

(56) References Cited

U.S. PATENT DOCUMENTS 4,123,031 A * 10/1978 Hyre ..... 249/24

* cited by examiner

*Primary Examiner*—Carl D. Friedman
*Assistant Examiner*—Chi Nguyen
(74) *Attorney, Agent, or Firm*—Lowe Hauptman Gilman & Berner, LLP

(57) ABSTRACT

Disclosed are a height-adjustable concrete mold supporting system and a method for constructing concrete floors and concrete walls, by which a concrete building can be easily and precisely constructed with enhanced cost-effectiveness. The system has a bottom bracket detachably disposed on a base member. First and second screw shafts are vertically assembled with the bracket. The first and the second screw shafts are movably inserted into first and second height adjusting tubes. A top mounting board is supported by the first and the second height adjusting tubes. The first and the second height adjusting tubes are fixed to the first and the second screw shafts so as to determine an adjusted space between the bracket and the mounting board.

8 Claims, 8 Drawing Sheets

HEIGHT-ADJUSTABLE CONCRETE MOLD SUPPORTING SYSTEM AND METHOD FOR CONSTRUCTING CONCRETE BUILDING

FIELD OF THE INVENTION

The present invention relates to a concrete mold supporting system and a method for constructing a concrete building through the use of the mold supporting system, and more particularly to a height-adjustable concrete mold supporting system and a method for constructing concrete floors and walls whereby a concrete building of precise size and configuration can be easily constructed with enhanced cost-effectiveness.

DESCRIPTION OF THE RELATED ART

Referring first to FIGS. 1*a* to 1*d* showing a conventional concrete building construction method by way of example, reinforcements 12 are disposed above a base member 10, and then wet concrete is applied up to a predetermined reference level 14. When the concrete is aged or dried so that a concrete floor body 16 is constructed, a fixing frame 18 for square timbers is disposed on the concrete floor body 16 by means of a plurality of pads such as pieces of plywood. Thereafter, a concrete wall mold 22 is uprightly mounted on the fixing frame 18, and then concrete is applied into and allowed to dry in the concrete wall mold 22.

When the concrete has been dried, the concrete wall mold 22 is detached to expose the hardened concrete wall body 24. Then again, another base member 10 is disposed on the concrete wail body 24, and then repeated is the above process including the steps of disposing reinforcements, and constructing the concrete floor body 16 and the concrete wall body 24. This results in a concrete building with a plurality of stories.

However, in the conventional method of constructing a concrete building as described above, since the concrete is applied to the reference level based on an rough estimation by a workers eye-sight, the size and surface configuration of the concrete floor body tends to vary bitterly depending on the individual workers judgement and skill. Moreover, since the fixing frame is disposed by interposing pads thereunder with reference to a highest point of the concrete floor body, it is very difficult to dispose the fixing frame in an exact horizontal level.

In addition, the thickness of the concrete floor body becomes larger than the designed dimension, so that the height of each story of the concrete building is increased. There may be also a problem in that a crack or a declination may be generated in the concrete building due to an increased load and an increased stress.

Further, when the concrete is applied into the concrete wall mold, the concrete may leak out of the clearance between the concrete floor body and the fixing frame, which must be eliminated by a separate task. In the conventional method, the clearance between the concrete floor body and the fixing frame is blocked by sheets of plywood, etc. However, it has been very difficult to completely block the clearance, which means the conventional method fails to completely prevent the leakage of the concrete. Also, the conventional method requires considerable work force and expense for detaching and disposing the fixing frame, the pads, and the concrete wall mold.

SUMMARY OF THE INVENTION

Accordingly, in view of the problems inherent in the related art, it is an object of the present invention to provide a concrete mold supporting system and a method for constructing concrete floors and concrete walls that assures precise and cost-effective construction of a concrete building with great ease.

In accordance with one aspect, the invention provides a height-adjustable concrete mold supporting system for use in constructing concrete floors and walls of a concrete building, the system comprising: a bracket detachably disposed on a base member; first and second screw shafts vertically assembled with the bracket; first and second height adjusting tubes into which the first and the second screw shafts are movably inserted; a mounting board supported by the first and the second height adjusting tubes; and means for fixing the first and the second height adjusting tubes to the first and the second screw shafts to determine an adjusted space between the bracket and the mounting board.

In accordance with another aspect, the invention provides a method for constructing a concrete building through the use of a height-adjustable concrete mold supporting device, the method comprising the steps of: a) attaching the concrete mold supporting device on a base floor; b) adjusting the height of the concrete mold supporting device into alignment with a target reference plane; and c) removably clamping a concrete mold on the concrete mold supporting device.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

A preferred embodiment of the present invention will be described in detail hereinafter with reference to the accompanying drawings.

Figure 1A:
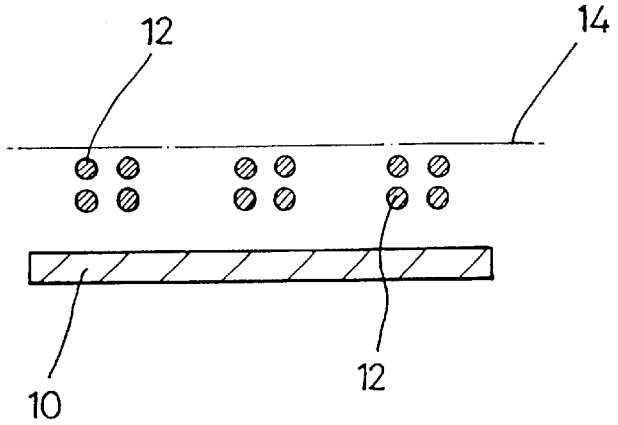
FIG. 1a (PRIOR ART)
FIGS. 1*a* to 1*d* are sectional views illustrating a conventional method for constructing concrete floors and concrete walls of a concrete building.
Figure 1B:
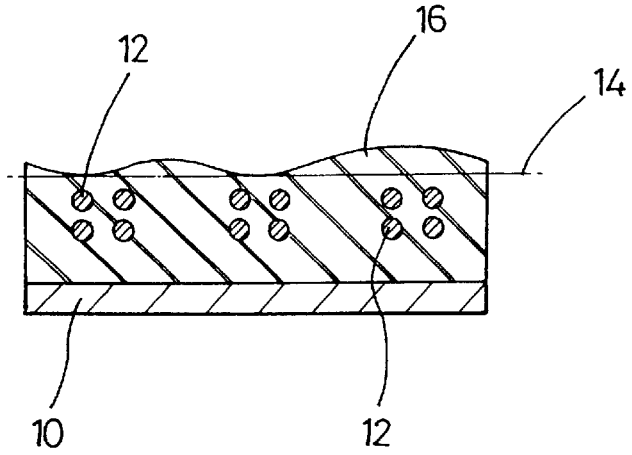
FIG. 1b (PRIOR ART)
Figure 1C:
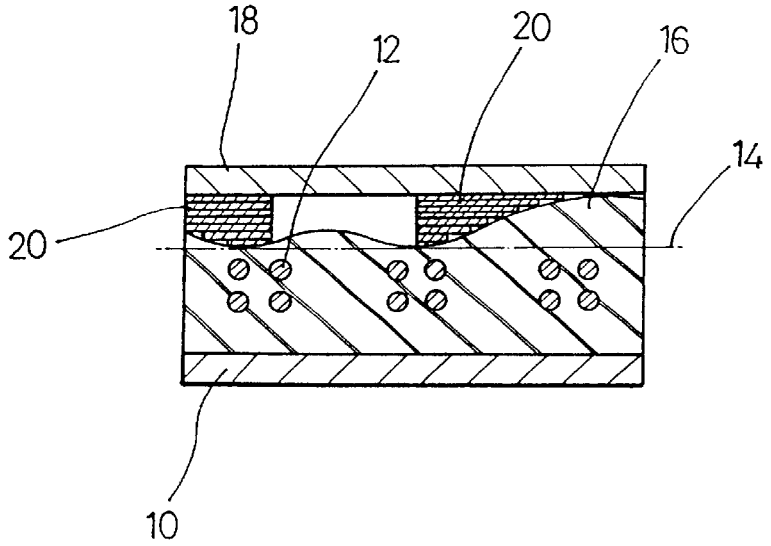
FIG. 1c (PRIOR ART)
Figure 1D:
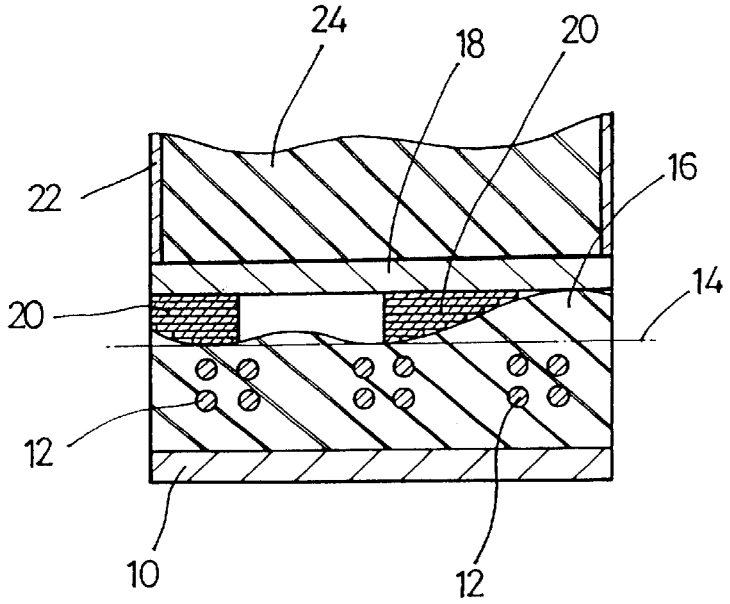
FIG. 1d (PRIOR ART)
Figure 2:
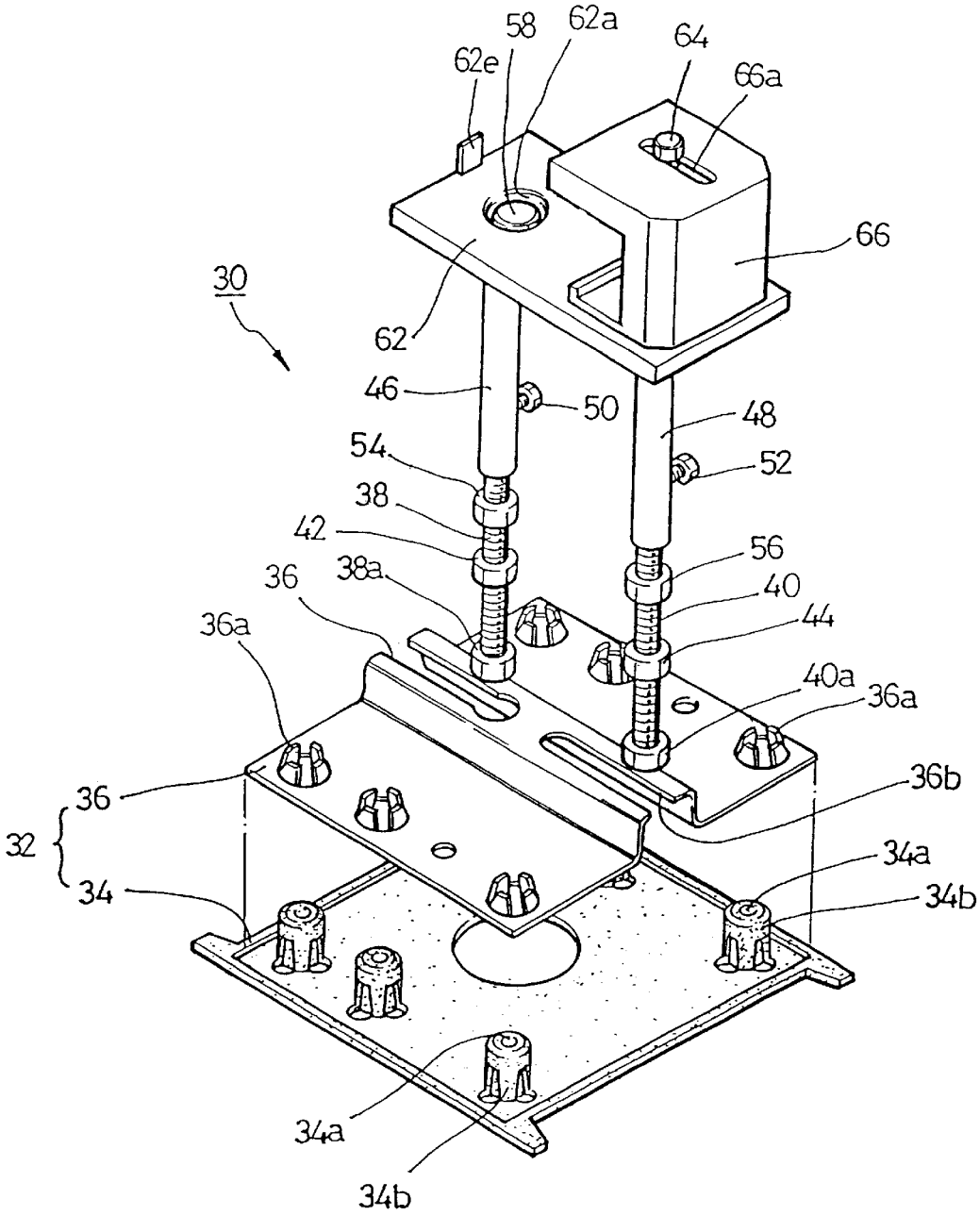
FIG. 2 is an exploded perspective view of a height-adjustable concrete mold supporting system according to an embodiment of the present invention.
Figure 3:
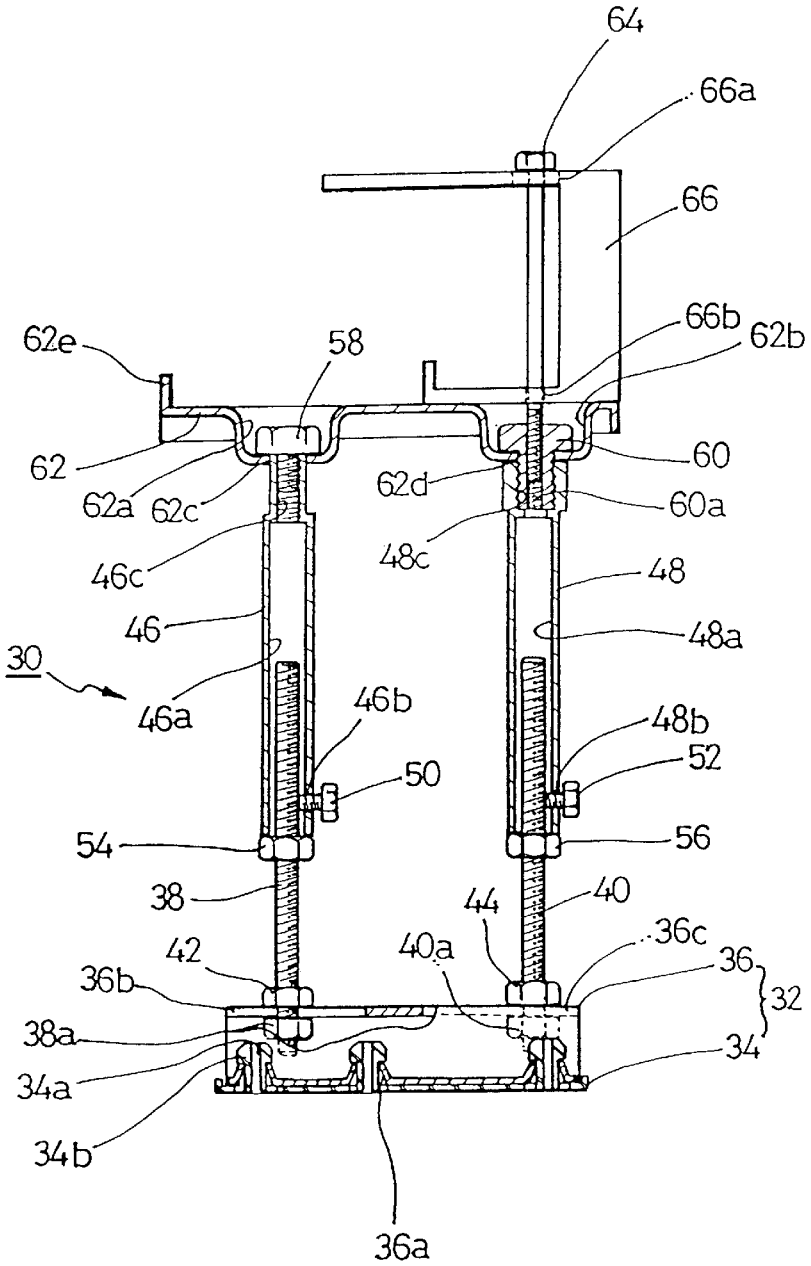
FIG. 3 is a side elevational section view of the mold supporting system shown in FIG. 2.

It can be appreciated in FIGS. 2 and 3 that a concrete mold supporting system 30 according to the invention includes a bottom anchor bracket 32 which has a fixed plate 34 and a supporting plate 36 assembled above the fixed plate 34. The fixed plate 34 has a plurality of engaging protuberances 34*b* fixed on and protruding upward from the upper surface of the fixed plate 34, each of which has a through hole 34*a* vertically extending through the engaging protuberance 34*b*. Preferably, the fixed plate 34 may be formed from material such as rubber or resin, which is capable of insulating heat conduction.

The supporting plate 36 has a plurality of engaging holes, each of which has a plurality of engaging snaps 36*a* arranged around each engaging hole. Each of the engaging protuberances 34*b* of the fixed plate 34 is inserted through each engaging hole and fixedly held by the engaging snaps 36*a*.

At an upper surface of the supporting plate 36 are formed first and second elongated holes 36*b* and 36*c* aligned in line with each other, through which first and second screw shafts 38 and 40 are respectively inserted. The first and the second screw shafts 38 and 40 respectively have first and second shaft heads 38*a* and 40*a* received under the first and the second elongated holes 36*b* and 36*c*. First and second nuts 42 and 44 are respectively fitted around the first and the second screw shafts 38 and 40, and are screwed to abut on upper surfaces of the first and the second elongated holes 36*b* and 36*c*, thereby maintaining the first and the second shaft heads 38*a* and 40*a* to abut on lower surfaces of the first and the second elongated holes 36*b* and 36*c*. Therefore, the main portions of the first and the second screw shafts 38 and 40 are disposed vertically above the first and the second elongated holes 36*b* and 36*c*.

Further, the concrete mold supporting system 30 includes first and second height adjusting tubes 46 and 48 respectively having first and second tube holes 46*a* and 48*a* into which are inserted the first and the second screw shafts 38 and 40. Inner diameters of the first and the second tube holes 46*a* and 48*a* are larger than outer diameters of the first and the second screw shafts 38 and 40. The first and the second height adjusting tubes 46 and 48 respectively have first and second adjusting screw holes 46*b* and 48*b* penetrating through the cylindrical walls of the first and the second height adjusting tubes 46 and 48. First and second adjusting screws 50 and 52 are respectively screwed through the first and the second adjusting screw holes 46*b* and 48*b* up to the outer surfaces of the first and the second screw shafts 38 and 40, so as to firmly hold the first and the second screw shafts 38 and 40 in the first and the second height adjusting tubes 46 and 48. Lower ends of the first and the second height adjusting tubes 46 and 48 are held by third and fourth nuts 54 and 56 screwed around the first and the second screw shafts 38 and 40.

The first and the second height adjusting tubes 46 and 48 respectively have first and second assembling screw holes 46*c* and 48*c* formed at upper ends thereof to hold thereon a top mounting board 62 with a bearing surface. The mounting board 62 has first and second recesses 62*a* and 62*b* through the bottom of which are formed first and second recess holes 62*c* and 62*d* respectively. First and second assembling screws 58 and 60 are screwed through the first and the second recess holes 62*c* and 62*d* into the first and the second assembling screw holes 46*c* and 48*c* so that the mounting board 62 is firmly held on the first and the second height adjusting tubes 46 and 48. The first and the second assembling screws 58 and 60 are completely screwed against the bottoms of the first and the second recesses 62*a* and 62*b* so that they do not protrude above the first and the second recesses 62*a* and 62*b*. The second assembling screw 60 has a center screw hole 60*a* formed longitudinally through the center axis thereof.

The mounting board 62 has a holding protuberance 62*e* formed at one end thereof. A clamp 66 is detachably assembled on the mounting board 62 by a bolt 64. The clamp 66 has first and second bolt holes 66*a* and 66*b* aligned with each other. The bolt 64 is inserted through the first and the second bolt holes 66*a* and 66*b* and then screwed into the center screw hole 60*a* so as to firmly assemble the clamp 66 with the mounting board 62.

Figure 4:
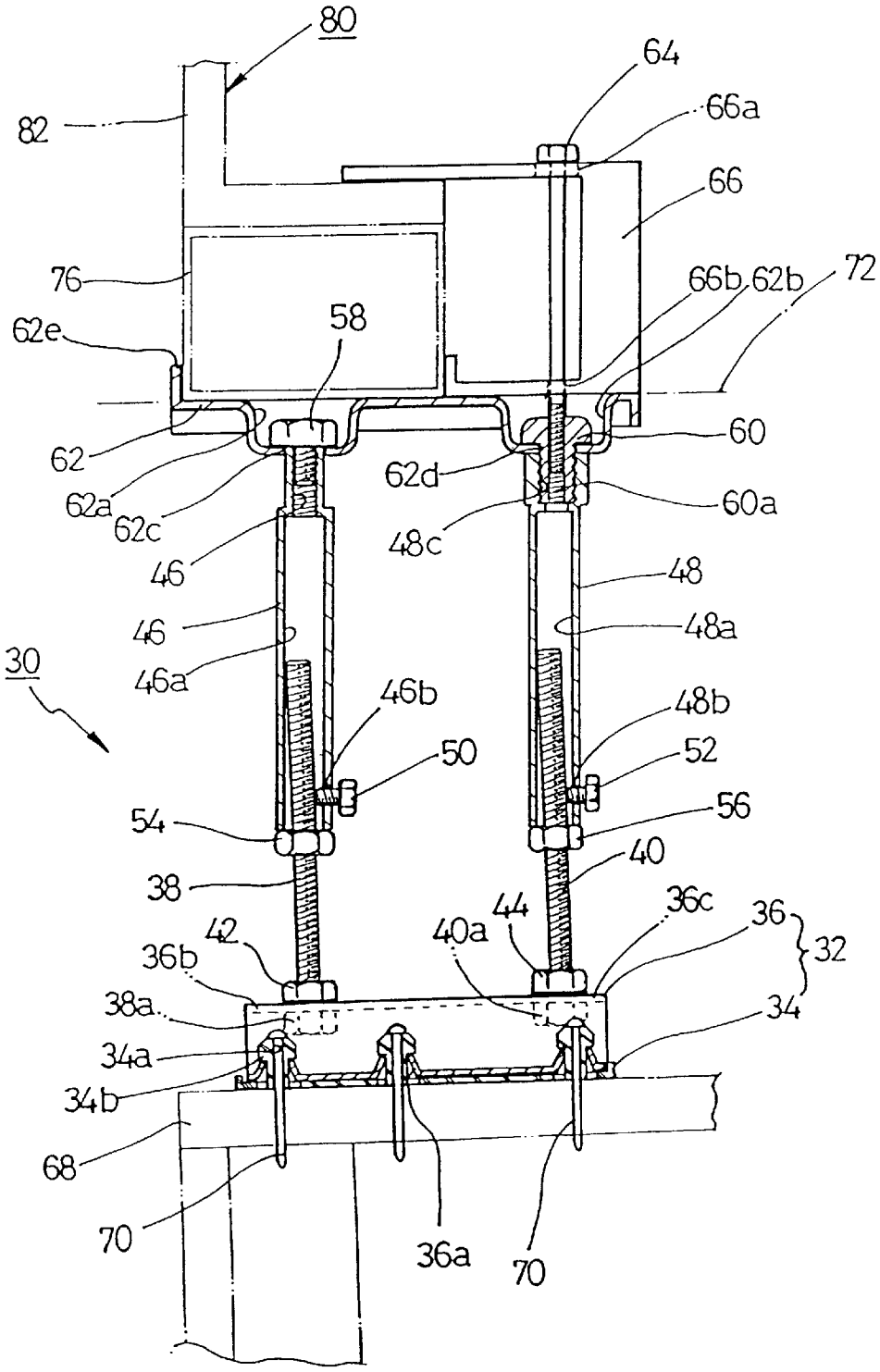
FIG. 4 is a view similar to FIG. 3 but showing the inventive system which is fixedly attached at its bottom end to a base floor and removably holds concrete mold parts at its top end.

As shown in FIG. 4, the bottom bracket 32 of the inventive system 30 is fixed onto a base member 68 by driving nails 70 through the through holes 34*a* of engaging protuberances 34*b* into the base member 68. Then, in a state that the first and the second adjusting screws 50 and 52 and the third and the fourth nuts 54 and 56 are released, the height of the first and the second height adjusting tubes 46 and 48 is so adjusted that the upper surface of the mounting board 62 becomes level with a predetermined reference level 72.

When the upper surface of the mounting board 62 is level with the reference level 72, the first and the second adjusting screws 50 and 52 are tightly screwed into the first and the second adjusting screw holes 46*b* and 48*b* so that the first and the second height adjusting tubes 46 and 48 are fixed to the first and the second screw shafts 38 and 40. Thereafter, the third and the fourth nuts 54 and 56 are firmly tightened on the first and the second screw shafts 38 and 40 against the lower ends of the first and the second height adjusting tubes 46 and 48 to aid the supporting or the fixing of the first and the second height adjusting tubes 46 and 48.

Hereinafter, described will be a method for constructing concrete floors and walls of a concrete building according to the present invention, with reference to FIGS. 5*a* through 5*d* and 6.

Figure 5A:
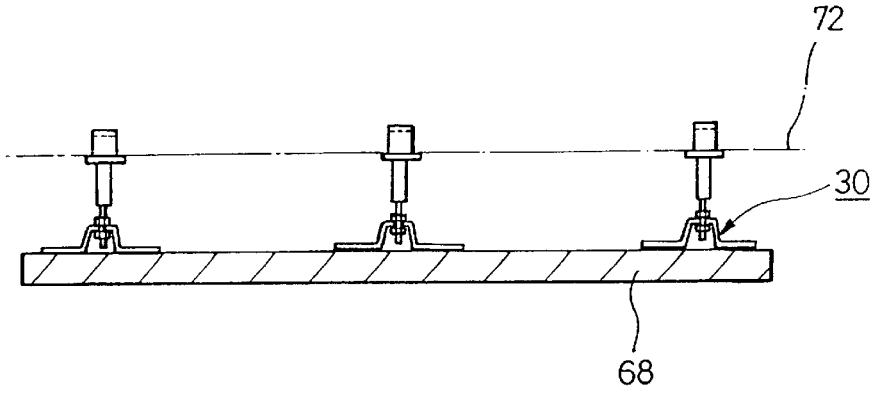
FIGS. 5*a* to 5*d* are partially enlarged sectional views illustrating a method for constructing concrete floors and concrete walls of a concrete building according to the present invention.

At first, as shown in FIG. 5*a*, the concrete mold supporting system 30 is fixedly secured on the base floor or member 68 in such a manner that the top bearing surface of the mounting board 62 is flush with the reference level 72 as described above with regard to FIG. 4. When it becomes necessary to adjust the distance between the bottom bracket 32 and the top mounting board 62, the first and the second screw shafts 38 and 40 are moved along the first and the second elongated holes 36*b* and 36*c* of the supporting plate 36 after the first and the second nuts 42 and 44 are released. Then, the first and the second nuts 42 and 44 are tightened again.

Figure 5B:
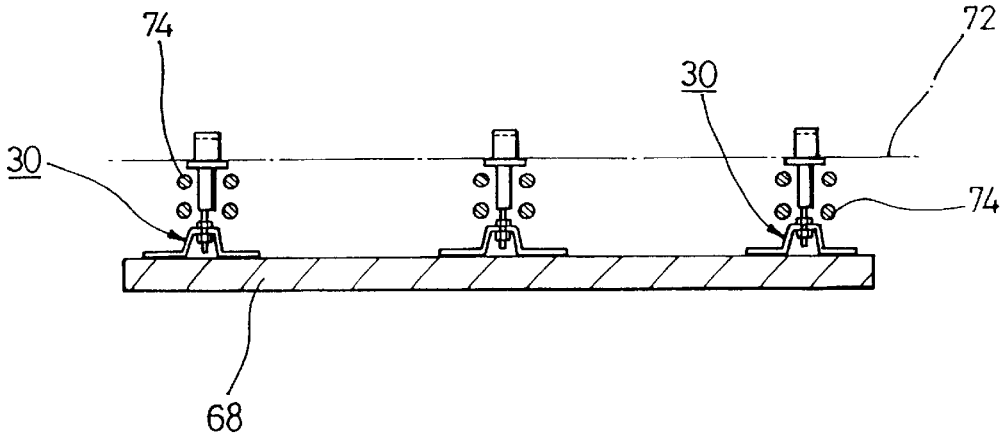
Figure 5C:
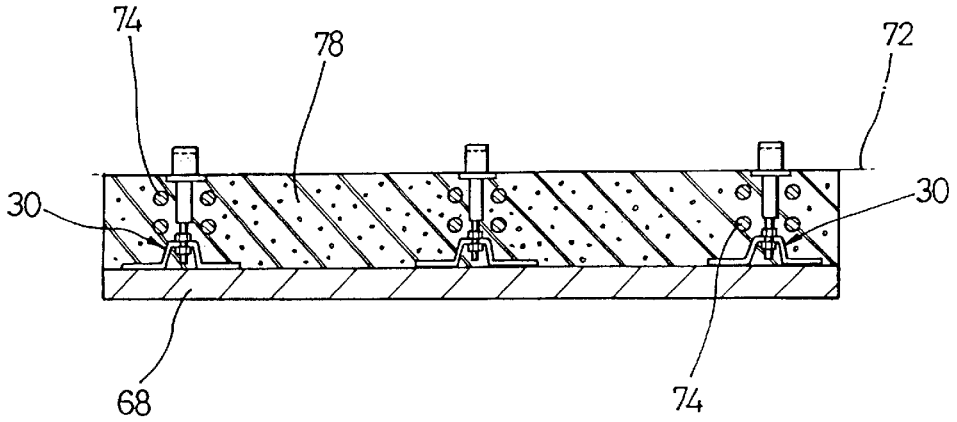

Thereafter, as shown in FIG. 5*b*, concrete reinforcing members 74, e.g., elongated steel bars, are disposed between the base member 68 and the reference level 72, and then, as illustrated in FIG. 5*c*, wet concrete is injected or applied between the upper surface of the base member 68 and the reference level 72. The concrete is allowed to be hardened for a sufficient period of time so that a concrete floor body 78 is constructed consequently. When the concrete has been applied up to the reference level 72, the inventive mold supporting system 30 is buried into the concrete floor body 78 with only the upper surface of the mounting board 62 being exposed to the outside.

A fixing frame 76 of square shape and a wall-forming mold 80, as concrete mold parts, are so fixed to the mold supporting system as to be firmly held by the holding protuberance 62*e* of the top mounting board 62 which serves as a clamp. When the fixing frame 76 has been fixed on the upper surface of the mounting board 62, the lower surface of the fixing frame 76 is flush with the reference level 72.

Figure 5D:
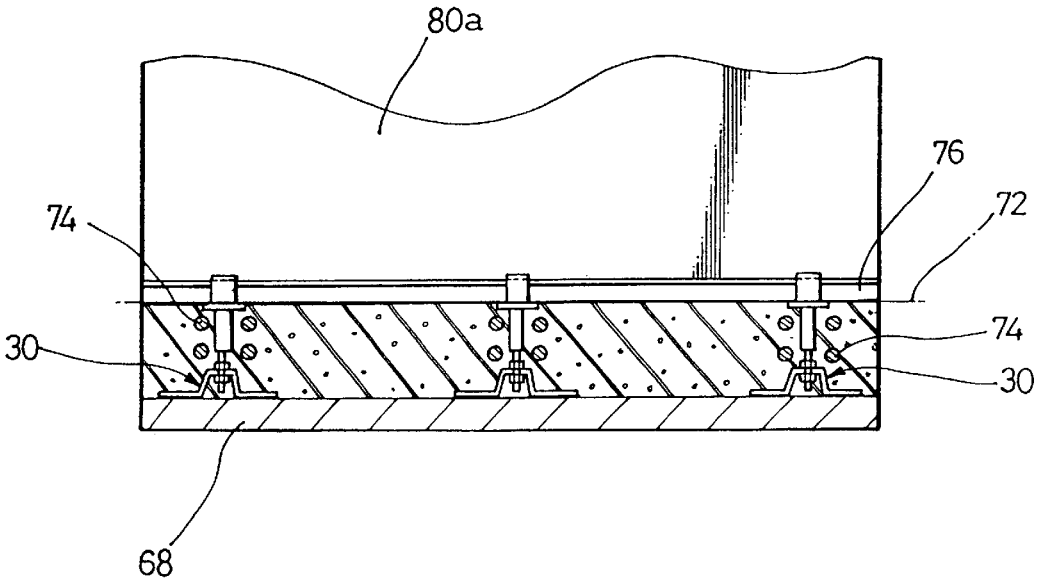
Figure 6:
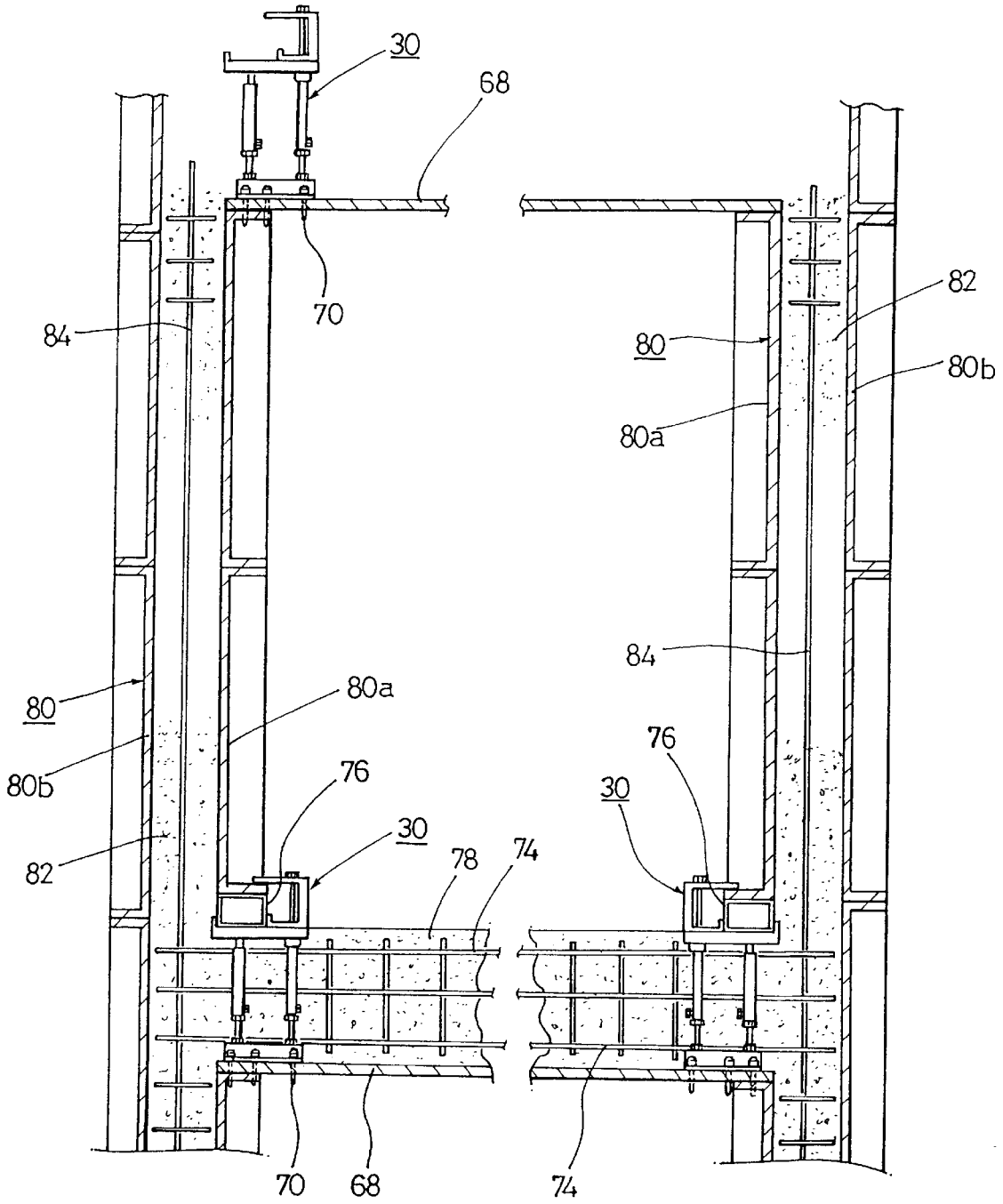
FIG. 6 is a partially cut-away sectional view of a concrete building constructed by use of the system and method of the present invention.

As clearly shown in FIGS. 5*d* and 6, the wall-forming mold 80 includes an inner plate 80*a* disposed on the upper surface of the fixing frame 76 and an outer plate 80*b* spaced a predetermined distance apart from the inner plate 80*a*. The lower end of the inner plate 80*a* is placed on the upper surface of the fixing frame 76, and the bolt 64 is tightened through the first and the second bolt holes 66*a* and 66*b* of the clamp 66 into the center screw hole 60*a* of the second assembling screw 60, so that the clamp 66 is fixedly assembled on the mounting board 62 with clamping the concrete wall mold 80 on the fixing frame 76.

When the wall-forming mold 80 has been completely assembled, wet concrete is injected into the inner space of the wall-forming mold 80 and allowed to dry therein, so that a concrete wall body 82 is constructed. At the end of hardening process of the wall body 82, the fixing frame 76 and the wall-forming mold 80 are removed. By reiterating the process of forming the concrete floor body 78 and the concrete wall body 82 as described above, a concrete building having a plurality of stories can be constructed.

Although the combination of tube and screw shaft is illustrated and described hereinabove as an example of the height-adjustor of the inventive mold supporting system, the invention shall not be limited thereto and other types of height-adjusting mechanism, for instance, pantograph lifter may equally be employed in place of the illustrated screw-type height adjustor.

It will be understood by those skilled in the art that various changes and modifications may be made to the illustrated embodiment without departing from the true scope of the present invention.

What is claimed is:

1. A height-adjustable concrete mold supporting system for use in constructing concrete floors and walls of a concrete building, the system comprising:

a bottom bracket detachably disposed on a base member;

first and second screw shafts vertically assembled with the bracket; first and second height adjusting tubes into which the first and the second screw shafts are movably inserted;

a top mounting board supported by the first and the second height adjusting tubes; and fixing elements for fixing the first and the second height adjusting tubes to the first and the second screw shafts to determine an adjusted space between the bracket and the mounting board;

wherein the bracket comprises a fixed plate and a supporting plate assembled above the fixed plate, the supporting plate having first and second elongated holes formed aligned in line with each other at an upper surface of the supporting plate, the first and the second screw shafts being inserted in and slidably held on the first and the second elongated holes, so that a distance of the mounting board from an adjacent mounting board can be adjusted by sliding the first and the second screw shafts along the first and the second elongated holes.

2. A height-adjustable concrete mold supporting system as claimed in claim 1, wherein the first and the second screw shafts respectively have first and second shaft heads formed at lower ends thereof, and first and second nuts are respectively fitted around the first and the second screw shafts, and are screwed to abut on upper surfaces of the first and the second elongated holes, thereby maintaining the first and the second shaft heads to abut on lower surfaces of the first and the second elongated holes.

3. A height-adjustable concrete mold supporting system for use in constructing concrete floors and walls of a concrete building, the system comprising:

a bottom bracket detachably disposed on a base member;

first and second screw shafts vertically assembled with the bracket;

first and second height adjusting tubes into which the first and the second screw shafts are movably inserted;

a top mounting board supported by the first and the second height adjusting tubes; and fixing elements for fixing the first and the second height adjusting tubes to the first and the second screw shafts to determine an adjusted space between the bracket and the mounting board;

wherein the fixed plate has a plurality of engaging protuberances fixed on and protruding upward from an upper surface of the fixed plate, and the supporting plate has a plurality of engaging snaps, each of the engaging protuberances of the fixed plate being fixedly held by the engaging snaps.

4. A height-adjustable concrete mold supporting system for use in constructing concrete floors and walls of a concrete building, the system comprising:

a bottom bracket detachably disposed on a base member;

first and second screw shafts vertically assembled with the bracket;

first and second height adjusting tubes into which the first and the second screw shafts are movably inserted;

a top mounting board supported by the first and the second height adjusting tubes; and fixing elements for fixing the first and the second height adjusting tubes to the first and the second screw shafts to determine an adjusted space between the bracket and the mounting board;

wherein the first and the second height adjusting tubes respectively have first and second adjusting screw holes penetrating through cylindrical walls of the first and the second height adjusting tubes, and said fixing means comprises first and second adjusting screws, and third and fourth nuts, the first and the second adjusting screws being respectively screwed through the first and the second adjusting screw holes up to outer surfaces of the first and the second screw shafts, and the third and the fourth nuts being respectively screwed around the first and the second screw shafts to support lower ends of the first and the second height adjusting tubes, so that the first and the second screw shafts are firmly held in the first and the second height adjusting tubes.

5. A height-adjustable concrete mold supporting system for use in constructing concrete floors and walls of a concrete building, the system comprising:

a bottom bracket detachably disposed on a base member;

first and second screw shafts vertically assembled with the bracket;

first and second height adjusting tubes into which the first and the second screw shafts are movably inserted;

a top mounting board supported by the first and the second height adjusting tubes; and fixing elements for fixing the first and the second height adjusting tubes to the first and the second screw shafts to determine an adjusted space between the bracket and the mounting board; and a clamp detachably assembled on the mounting board to clamp a concrete wall mold;

wherein the first and the second height adjusting tubes respectively have first and second assembling screw holes formed at upper ends thereof, the mounting board has first and second recesses through bottoms of which are formed first and second recess holes respectively, and first and second assembling screws are screwed through the first and the second recess holes into the first and the second assembling screw holes so that the mounting board is firmly held on the first and the second height adjusting tubes.

6. A height-adjustable concrete mold supporting system as claimed in claim 5, wherein the second assembling screw has a center screw hole formed longitudinally through a center axis thereof, and the clamp has first and second bolt holes aligned with each other, the clamp being firmly assembled on the mounting board by inserting a bolt through the first and the second bolt holes and then screwing the bolt into the center screw hole.

7. A height-adjustable concrete mold supporting system as claimed in claim 6, wherein the mounting board has a holding protuberance formed at one end thereof to hold a fixing frame, and the bolt is screwed through the first and the second bolt holes of the clamp into the center screw hole of the second assembling screw, so that the clamp is fixedly assembled on the mounting board with clamping the concrete wall mold on the fixing frame.

8. A height-adjustable concrete mold supporting system as claimed in claim 7, wherein the concrete wall mold comprises an inner plate and an outer plate spaced with a predetermined gap from the inner plate, the inner plate having a lower end placed on an upper surface of the fixing frame.

* * * * *